United States Patent [19]

Zedrosser

[11] Patent Number: 4,928,597

[45] Date of Patent: May 29, 1990

[54] RING FUZE FOR FIREARM AMMUNITION

[75] Inventor: Ulrich Zedrosser, Steyr, Austria

[73] Assignee: Steyr-Daimler-Puch AG, Vienna, Austria

[21] Appl. No.: 351,761

[22] Filed: May 15, 1989

[30] Foreign Application Priority Data

Jun. 21, 1988 [AT] Austria ..... A1601/88

[51] Int. Cl.[5] ..... F42B 5/00

[52] U.S. Cl. ..... 102/430; 102/204; 102/470

[58] Field of Search ..... 102/430, 469, 470, 471, 102/204

[56] References Cited

U.S. PATENT DOCUMENTS

| | | | |
|---|---|---|---|
| 1,317,609 | 9/1919 | Barlow | 102/204 |
| 2,379,056 | 6/1945 | Alexander . | |
| 3,060,855 | 10/1962 | Henning et al. | 102/469 |
| 3,611,937 | 10/1971 | Hildebrand . | |
| 3,786,761 | 1/1974 | Ciccone et al. | 102/469 |
| 3,808,973 | 5/1974 | Galluzzi . | |
| 3,916,793 | 11/1975 | Galluzzi . | |
| 4,236,451 | 12/1980 | Galluzzi . | |
| 4,537,134 | 8/1985 | Galluzzi . | |

FOREIGN PATENT DOCUMENTS

| | | | |
|---|---|---|---|
| 703809 | 5/1931 | France | 102/204 |
| 1210603 | 3/1960 | France | 102/204 |

*Primary Examiner*—Harold J. Tudor

*Attorney, Agent, or Firm*—Marmorek, Guttman & Rubenstein

[57] ABSTRACT

A ring fuze for firearm ammunition comprises a hollow fuze ring, which contains a primer. A functionally reliable ring fuze which can easily be manufactured and can be used without a need for a separate abutment is substantially U-shaped in cross-section and its axially extending inner leg and preferably also its bottom are thicker than its axially extending outer leg.

8 Claims, 1 Drawing Sheet

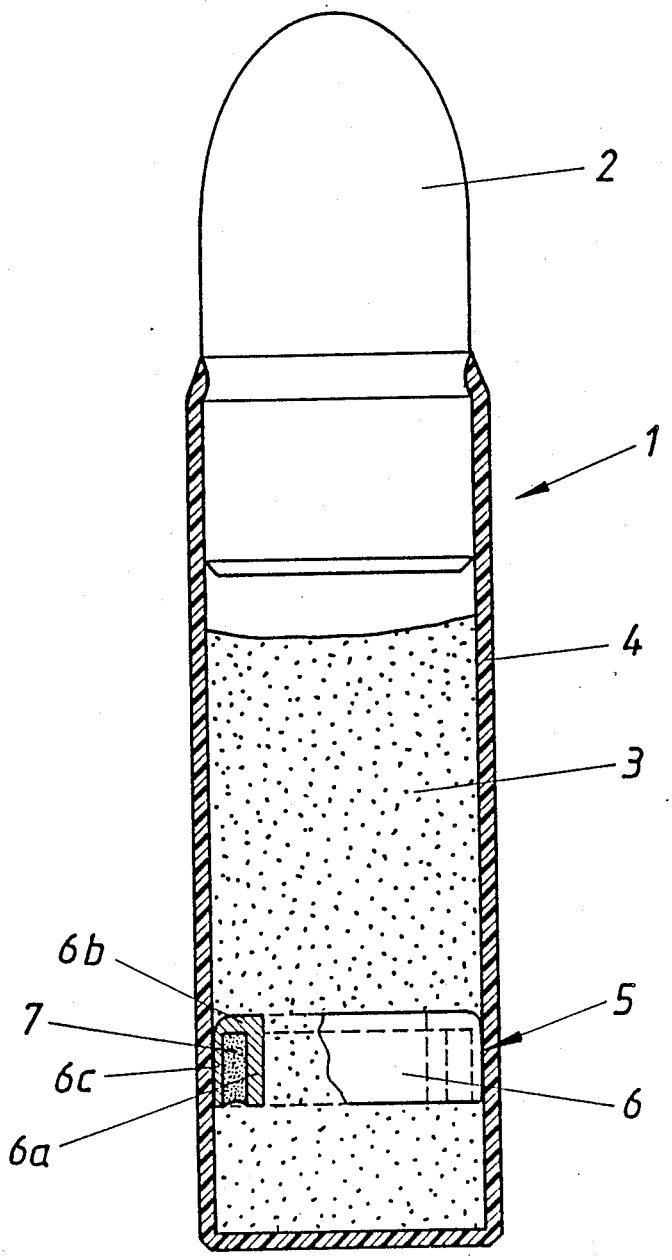
2
1
4
3
6b
7
6c
6a
5
6

RING FUZE FOR FIREARM AMMUNITION

BACKGROUND OF THE INVENTION

1. Field of the Invention

This invention relates to a ring fuze for firearm ammunition, particularly for rifle cartridges, which fuze comprises a hollow fuze ring, which contains a primer.

2. Description of the Prior Art

Firearms which comprise a firing device which is disposed laterally of the chamber or comprise a firing pin which laterally enters the chamber must be furnished with ammunition provided with peripheral fuzes. It is already known to provide ring fuzes consisting of pocketlike annular grooves which are formed in the cartridge cases and filled with a primer (see U.S. Pat. Nos. 2,379,056 and 3,611,937). It has also been suggested to provide for caseless cartridges a ring fuze having a hollow fuze ring, which is closed in itself (see U.S. Pat. Nos. 3,808,973, 3,916,793, 4,236,451 and 4,537,134) and which consists of paper or another easily inflammable material and is filled with a primer, which can locally be squeezed to effect the detonation proper. But the manufacture of said known ring fuzes is expensive because they can be filled with the primer only by a complicated operation. Besides, they require the provision of a separate abutment consisting of the projectile which is fitted in the cartridge case, or of a specially designed cartridge case, so that the firing energy which has been applied by the firing pin is actually utilized to squeeze the primer and is not rendered ineffective by excessively large deforming work that is required. Said special abutments involve an additional expenditure and require the ring fuze to be arranged in a position which depends on the design of the cartridge which is employed or on the design of the abutment provided on said cartridge. That requirement renders the adaptation of the ring fuze ammunition to the firing systems of various firearms rather difficult.

Known cartridges for implements for shooting fasteners into workpieces comprise a spoollike ring fuze (see U.S. Pat. Nos. 2,931,039 and 3,060,855), which has an open peripheral groove that contains a primer. In that case too it is difficult to fill the open groove and the fuze is rather expensive because the primer must subsequently be pressed. There are also variations in the detonating characteristic and irregularlities occur in the detonation of the propellant charge, which is contained in the cartridge case and is accessible only thorugh rim notches. Because the primer must be squeezed between the spool and the cartridge case to effect a detonation, said fuzes cannot be used with plastic cases, which would damp the impact of the firing pin and may result in a failure to fire.

SUMMARY OF THE INVENTION

For this reason it is an object of the invention to eliminate said disadvantages and to provide a ring fuze which is of the kind described first hereinbefore and can economically be manufactured, can be used freely independently of the design of the cartridge proper, and ensures a fully reliable function even with cartridges having plastic cases.

This object is accomplished in accordance with the invention in that the fuze ring is substantially U-shaped in cross-section and its axially extending inner leg and preferably also its bottom is thicker than the axially extending outer leg. That simple open fuze ring can be made economically and can be filled without difficulty. Besides, its thicker inner leg and its thicker bottom, which further increases the stiffness, constitute the abutment which is required for the firing operation. The outer leg may be rather thin-walled and will facilitate the squeezing of the primer by a firing pin. The fuze ring can be inserted into the cartridge case without a need for a separate abutment and can be used with various cartridges and kinds of ammunition with or without plastic cases. In dependence on the firing system of the firearms which are employed the position of he fuze ring may be chosen freely in wide ranges. In order to influence the combustion operation taking place as the propellant charge is detonated and burning off, the fuze ring can be inserted into the cartridge case with its open side facing in or opposite to the shooting direction. The open fuze ring ensures also that the propellant charge will be detonated directly and the detonation will be uniform around the periphery.

An economical, strong and functionally reliable ring fuze will be obtained if the fuze ring consists of aluminum or an aluminum alloy and the thickness of the inner leg and optionally also of the bottom is about twice the thickness of the outer leg.

BRIEF DESCRIPTION OF THE DRAWING

The drawing is an axial sectional view showing a cartridge which is provided with a ring fuze which embodies the invention.

DETAILED DESCRIPTION OF THE PREFERRED EMBODIMENT

A cartridge 1 comprises a projectile 2 and a case 4, which contains a propellant charge 3. The cartridge 1 is provided with a ring fuze 5, which consists of a fuze ring 6, which is U-shaped in cross-section, and a primer 7, which has been pressed into the cavity that is defined by the U-shaped cross-section. The axially extending inner leg *6a* and the bottom *6b* of the fuze ring 6 are thicker than the axially extending outer leg *6c* of the fuze ring 6. As a result, the inner leg *6a* and the bottom *6b* constitute an abutment, against which the primer 7 can be squeezed by a radially acting firing pin to effect a detonation. The fuze ring 6 can economically be filled with the primer outside the case 4 and the primer is sealed in the fuze ring or is held therein by another closure so that the primer will not fall out of the fuze ring as the fuze is inserted into the cartridge case and the primer will not be moistened in storage. The ring fuze is simply inserted into the case 4 with the open side ahead. The axial position of the ring fuze in the case may freely be selected in dependence on the firing system of the associated firearm. Whereas the ring fuze may be held in position in the case 4 by a suitable interference fit, bulges formed in the case or different spacing means may be provided to hold the ring fuze in position in the case 4.

I claim:

1. A ring fuze for firearm ammunition, comprising a hollow fuze ring for mounting in a cartridge case and a primer contained in said fuze ring, said fuze ring being substantially U-shaped in cross-section and comprising a bottom, an axially extending outer leg positioned adjacent an outer wall of said cartridge case which extends parallel to said outer leg, and an axially extending inner leg, said inner leg being thicker than said outer leg, said fuze ring being open to the interior of said cartridge case on a side away from said bottom, said outer leg igniting said primer when said outer wall is struck laterally by a firing pin.

2. The ring fuze set forth in claim 1, wherein said bottom is also thicker than said outer leg.

3. The ring fuze set forth in claim 1, wherein said fuze ring consists of a material selected from the group consisting of aluminum and aluminum alloys and the thickness of said inner leg is about twice the thickness of said outer leg.

4. The ring fuze set forth in claim 3, wherein the thickness of said bottom is about twice the thickness of said outer leg.

5. The ring fuze set forth in claim 1 wherein said inner leg forms an abutment means for said firing pin, said primer being compressed against said inner leg and being ignited when said outer wall is struck laterally by said firing pin.

6. The ring fuze set forth in claim 5 wherein said bottom also forms an abutment means for said firing pin, said primer being compressed against said bottom and being ignited when said outer wall is struck laterally by said firing pin.

7. Firearm ammunition, comprising a cartridge case and a ring fuze mounted in said cartridge case, said ring fuze comprising, a hollow fuze ring and a primer contained in fuze ring, said fuze ring being substantially U-shaped in cross-section and comprising a bottom, an axially extending outer leg positioned adjacent an outer wall of said cartridge case which extends parallel to said outer leg, and an axially extending inner leg, said inner leg being thicker than said outer leg, said fuze ring being open to the interior of said cartridge case on a side away from said bottom, said outer leg igniting said primer when said outer wall is struck laterally by a firing pin.

8. The firearm ammunition of claim 7 wherein said cartridge case is in the form of a rifle cartridge.

* * * * *